US009358779B2

(12) United States Patent
Miyazaki et al.

(10) Patent No.: US 9,358,779 B2
(45) Date of Patent: Jun. 7, 2016

(54) APPARATUS AND METHOD FOR DRIVING THE SAME

(71) Applicant: CANON KABUSHIKI KAISHA, Tokyo (JP)

(72) Inventors: Kyota Miyazaki, Tama (JP); Akira Yamamoto, Yokohama (JP); Yasuhiko Osaki, Yokohama (JP); Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/923,171

(22) Filed: Oct. 26, 2015

(65) Prior Publication Data

US 2016/0114577 A1 Apr. 28, 2016

(30) Foreign Application Priority Data

Oct. 28, 2014 (JP) ..... 2014-219049

(51) Int. Cl.
*B41J 2/045* (2006.01)

(52) U.S. Cl.
CPC ..... *B41J 2/0451* (2013.01); *B41J 2/0458* (2013.01)

(58) Field of Classification Search
CPC .... B41J 2/0451; B41J 2/0458; B41J 2/04586; B41J 29/393; B41J 11/009; B41J 29/38
See application file for complete search history.

(56) References Cited

U.S. PATENT DOCUMENTS 6,890,058 B2 * 5/2005 Nunokawa et al. ..... B41J 2/145 347/40
8,272,710 B2 * 9/2012 Spaulding et al. ..... B41J 19/142 347/15

FOREIGN PATENT DOCUMENTS

JP 2001-105632 A 4/2001

* cited by examiner

*Primary Examiner* — Thinh Nguyen
(74) *Attorney, Agent, or Firm* — Canon U.S.A., Inc., IP Division

(57) ABSTRACT

An apparatus that performs recording using a recording head provided with a plurality of ejection port arrays each including a plurality of ejection ports for ejecting a liquid and heaters each provided corresponding to each of the ejection ports, the ejection port arrays being disposed on a printing element board and arranged in a predetermined direction, the apparatus including a driving unit configured to drive the heaters corresponding to the ejection ports in the plurality of ejection port arrays to eject the liquid, the driving unit giving priority to the heater corresponding to other ejection port array except for a first ejection port array and a second ejection port array of both sides in the predetermined direction among the plurality of ejection port arrays disposed in the predetermined direction to drive for recording.

10 Claims, 7 Drawing Sheets

APPARATUS AND METHOD FOR DRIVING THE SAME

BACKGROUND OF THE INVENTION

1. Field of the Invention

The present invention relates to a recording apparatus and a method for driving the same. More particularly, the present invention relates to a technique to selectively use ejection port arrays in a recording head that has a plurality of ejection port arrays provided with a plurality of arranged ejection ports through which ink is ejected.

2. Description of the Related Art

In a recording method of an inkjet recording apparatus, which is a recording apparatus employing a nonimpact recording scheme, uses a heater in a printing element. In the recording head of this scheme, driving pulses are applied to the heater in a nozzle to provide thermal energy to the ink, causing a phase change to the ink. Thus, film boiling pressure of the ink is caused to eject ink droplets from the ejection ports toward a recording medium. The heater is provided in a printing element board joined to a support member in which an ink channel is formed.

Japanese Patent Laid-Open No. 2001-105632 discloses a technique to address a problem of a variation in ejection characteristics among ejection ports in a recording head in which a heater is used. If such a variation appears as unevenness of density, appropriate density correction is performed in the disclosed technique even if the appearance of the unevenness of density differs. Specifically, density correction is performed by selecting an appropriate density correction table depending on the kind of images to be recorded.

SUMMARY OF THE INVENTION

The present invention provides an apparatus including: recording head provided with a plurality of ejection port arrays each including a plurality of ejection ports for ejecting ink and heaters each provided corresponding to each of the ejection ports, the ejection port arrays being disposed on a printing element board and arranged in a predetermined direction, a driving unit configured to drive the heaters corresponding to the ejection ports in the plurality of ejection port arrays to eject the ink, the driving unit giving priority to the heater corresponding to other ejection port array except for a first ejection port array and a second ejection port array of both sides in the predetermined direction among the plurality of ejection port arrays disposed in the predetermined direction to drive for recording.

The present invention also provides a method for driving a recording head provided with a plurality of ejection port arrays each including a plurality of ejection ports for ejecting ink and heaters each provided corresponding to each of the ejection ports, the ejection port arrays being disposed on a printing element board and arranged in a predetermined direction, the method including: a driving step of driving the heaters corresponding to the ejection ports in the plurality of ejection port array to eject the ink, the driving step giving priority to the heater corresponding to other ejection port array except a first ejection port array and a second ejection port array of both sides in the predetermined direction among the plurality of ejection port arrays disposed in the predetermined direction to drive for recording.

The present invention also provides a method for driving a recording head provided with a plurality of ejection port arrays each including a plurality of ejection ports for ejecting ink and heaters each provided corresponding to each of the ejection ports, the ejection port arrays being disposed on a printing element board and arranged in a predetermined direction, the method including a driving step of driving the heaters corresponding to the ejection ports in the plurality of ejection port array to eject the ink, the driving step giving priority to the heater corresponding to other ejection port array except a first ejection port array and a second ejection port array of both sides in the predetermined direction among the plurality of ejection port arrays disposed in the predetermined direction to drive for recording.

Further features of the present invention will become apparent from the following description of exemplary embodiments with reference to the attached drawings.

DESCRIPTION OF THE EMBODIMENTS

Generally, in an inkjet recording apparatus having a recording head in which a heater is used, an ink ejection volume is increased or decreased depending on the fluctuation in viscosity of ink due to the temperature change of a printing element board. Therefore, if the temperature of the printing element board is not uniform, the ink ejection volume may differ in different regions on the printing element board and the density may become uneven in a recorded image. In a recording head that ejects a plurality of colors of ink on one printing element board, intended color may be failed to be reproduced due to fluctuation of ink volume of each color to be superimposed on the recording medium.

Figure 1:
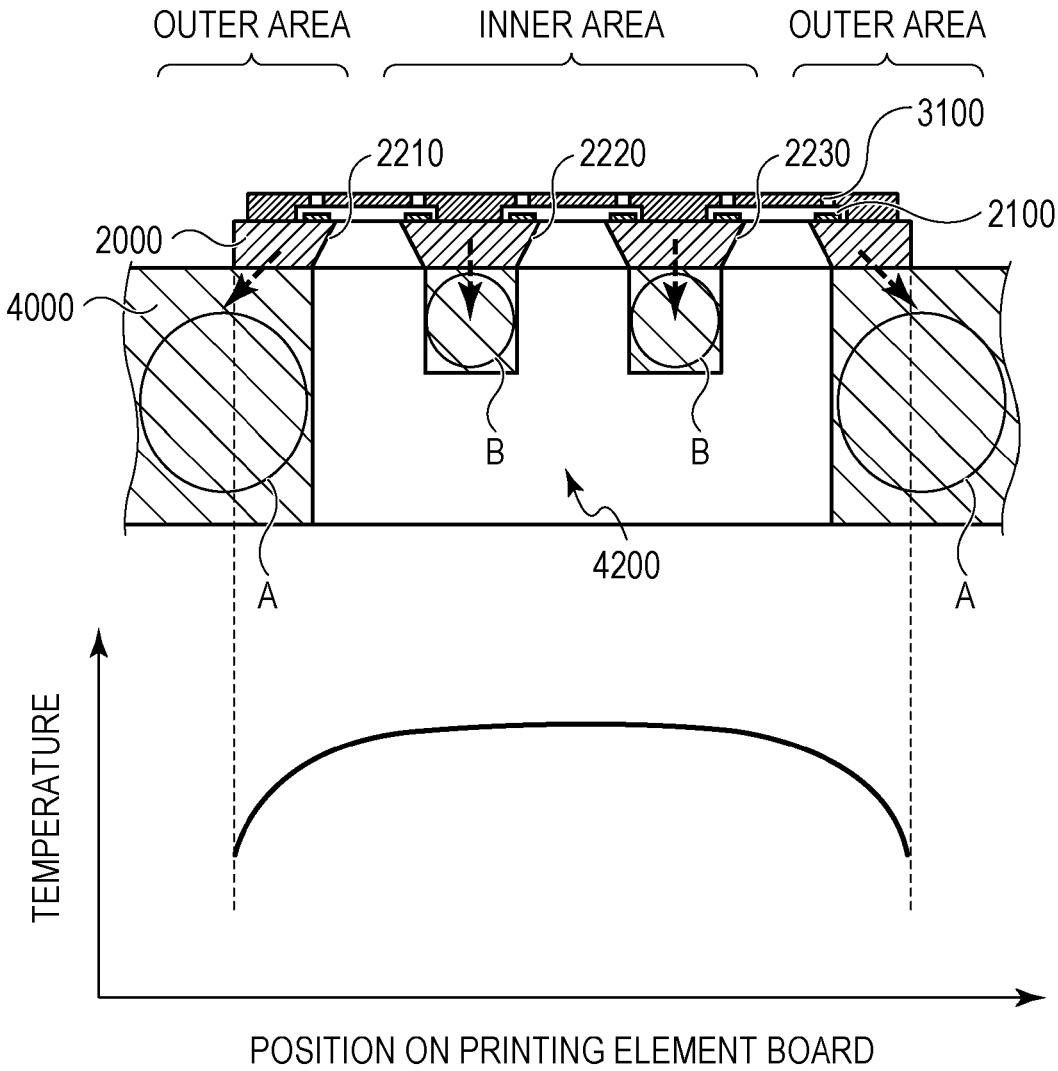
FIG. 1 illustrates a cross-sectional configuration of a recording head used in an exemplary recording apparatus and temperature distribution in the recording head.

FIG. 1 illustrates a cross-sectional configuration of a recording head in which a heater is used. With reference to FIG. 1, occurrence of uneven temperature distribution on the printing element board is described. FIG. 1 illustrates a cross section vertical to the arranging direction of the ejection ports arranged linearly on the printing element board.

In the recording head of FIG. 1, thermal energy from a heater 2100 is radiated from a surface of a printing element board 2000, and transferred to and radiated from a back surface of the printing element board 2000 along a support member 4000. A volume of the support member 4000 at a portion A corresponding to an outer area of the printing element board 2000 is greater than a volume of the support member 4000 at a portion B corresponding to an inner area of the printing element board 2000. Therefore, since (heat capacity of the portion A)>(heat capacity of the portion B) holds, regarding radiation from the back surface of the printing element board 2000, a greater amount of heat is radiated from the outer area of the printing element board 2000 than from the inner area thereof. Since the heat radiation from the surface of the printing element board 2000 is uniform, uneven temperature distribution occurs on the printing element board 2000. Specifically, the temperature becomes lower on both ends of the printing element board 2000 as illustrated in the lower half of FIG. 1. Such temperature distribution causes problems of unevenness of density and color reproducibility as described above. The problem of unevenness of density resulting from uneven temperature distribution cannot be solved by using an appropriate density correction table described in Japanese Patent Laid-Open No. 2001-105632 depending on the kind of the images.

First Embodiment

Figure 2:
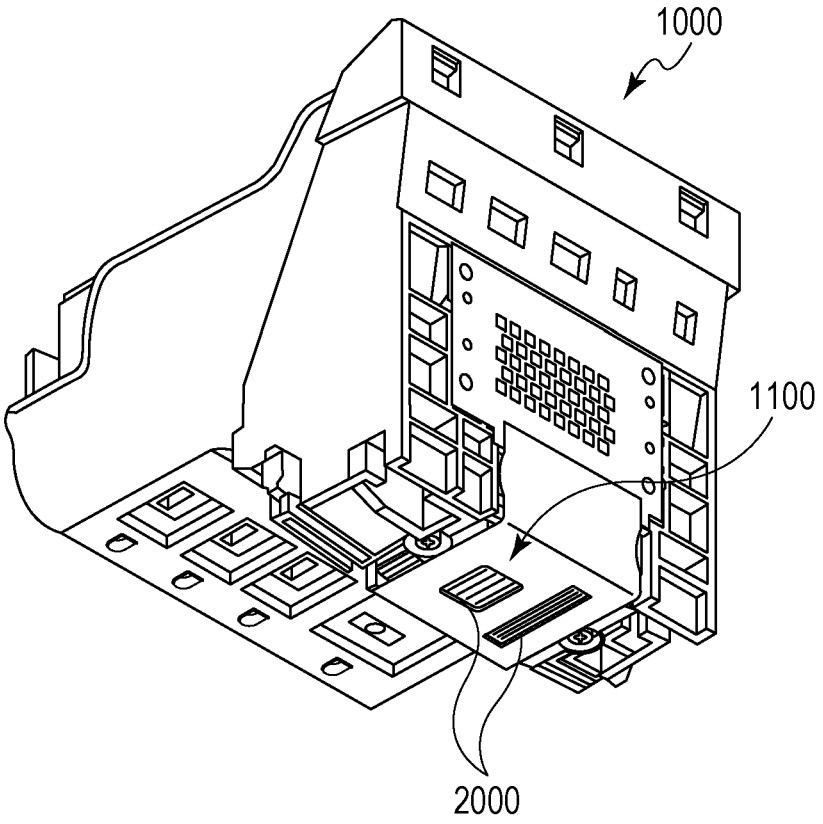
FIG. 2 is an exterior perspective view of the recording head used in the recording apparatus according to a first embodiment of the present invention.

A recording apparatus according to a first embodiment of the present invention is a serial scanning inkjet recording apparatus, on which a serial type recording head 1000 is mounted of which exterior is illustrated in FIG. 2 as an example. The recording head 1000 that ejects a liquid, such as ink, includes a recording element unit 1100 for single color ink. The recording element unit 1100 includes a printing element board 2000 and a support member (not illustrated). The recording element unit 1100 uses a heater disposed to face the ink ejection ports. Although at least one recording element unit 1100 is provided, a plurality of recording element units 1100 may be arranged next to one another to perform color recording. In the recording element unit 1100, the heater is driven to generate heat in accordance with drive signals based on image data for an image to be recorded, film boiling is caused by the thermal energy, and the film boiling pressure causes the ink droplets to eject from the ejection ports toward the recording medium.

Figure 3:
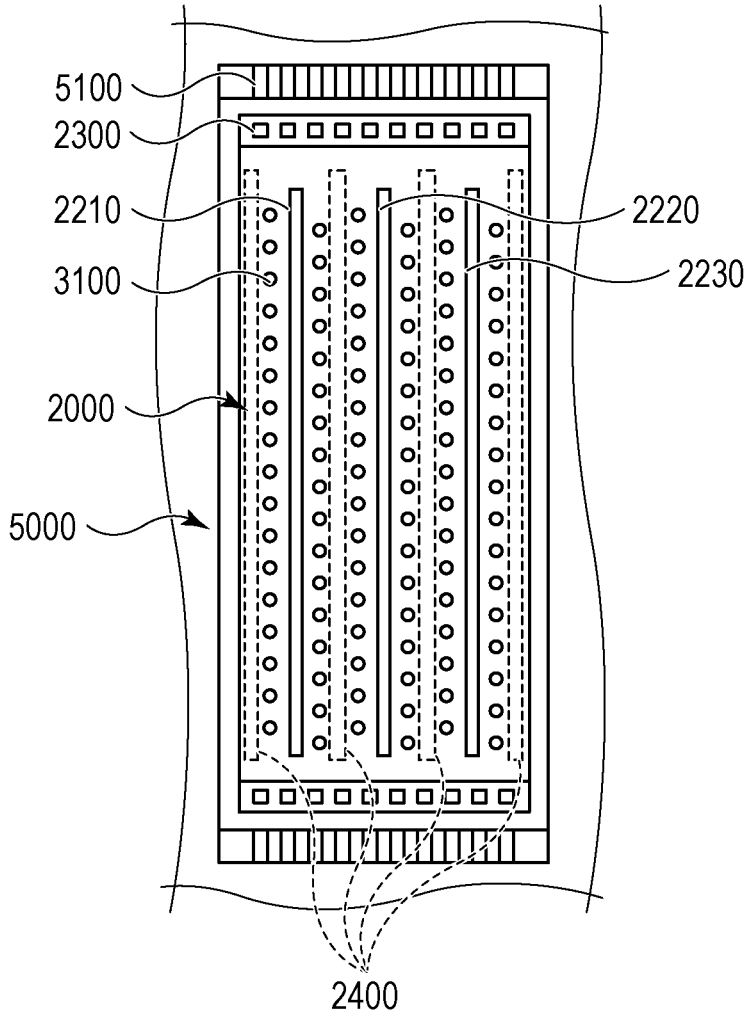
FIG. 3 is a schematic plan view of the recording head of FIG. 2.
Figure 4A:
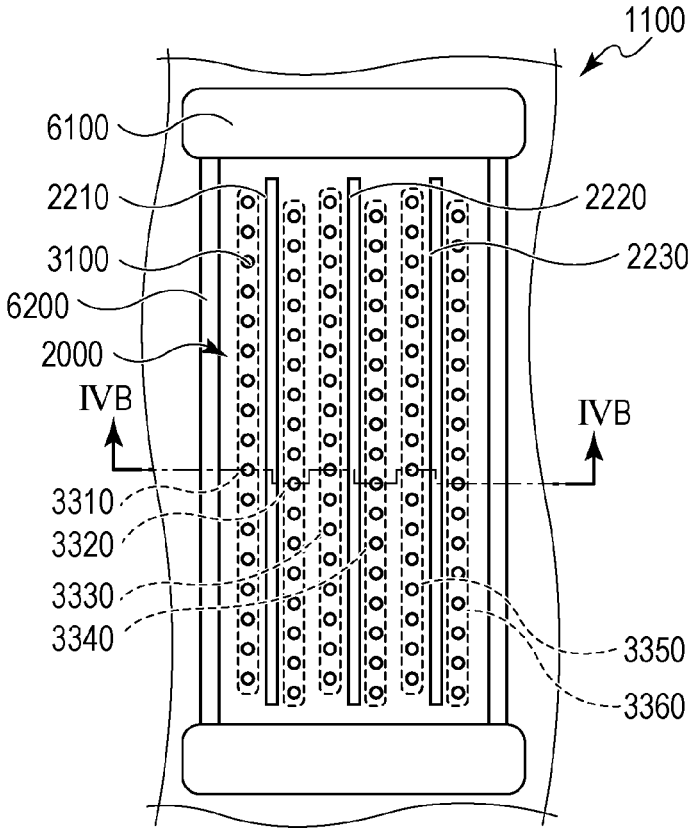
FIG. 4A is a schematic plan view and FIG. 4B is a schematic cross sectional view of the recording head of FIG. 2.
Figure 4B:
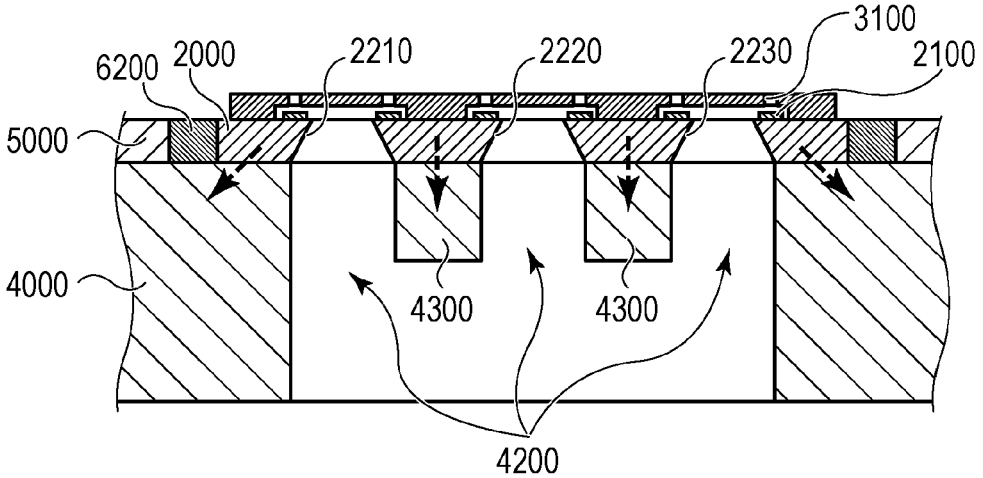

Hereinafter, a configuration of the recording element unit 1100 is described in detail with reference to FIGS. 3 and 4. FIG. 3 is a plan view schematically illustrating a state where a printing element board and an electric wiring member are disposed on a support member. FIG. 4A schematically illustrates a plane in the state where peripheries of the electric connection portion and the printing element board are sealed, and FIG. 4B schematically illustrates the cross section thereof.

The printing element board 2000 is formed by, for example, a 0.5 to 1 mm-thick Si substrate in which ink supply ports 2210, 2220, and 2230 that are elongated groove-shaped through holes communicating with an ink channel 4200 as a liquid channel are formed and arranged in parallel with one another. The ink supply ports 2210 to 2230 are formed by immersing the Si substrate in an etching solution, such as tetramethylammonium hydroxide (TMAH) and potassium hydroxide (KOH). The heaters 2100 and a driving circuit 2400 that drives the heaters 2100 are formed along each of the ink supply ports 2210 to 2230 by semiconductor processes. Electrode portions 2300 are formed at both end portions of the printing element board 2000. On the printing element board 2000, a pressure chamber that surrounds the heaters 2100 and ink supply channels through which ink is supplied to the pressure chamber from the ink supply port 2220 are formed by a resin material by photolithography. Ejection ports 3100 are formed at positions facing the heaters 2100.

The support member 4000 is formed by, for example, 0.5 to 10-mm thick alumina. The material of the support member 4000 is not limited to alumina: any materials having the coefficient of linear expansion equivalent to that of the material of the printing element board 2000 may be employed. Of these materials, and which have thermal conductivity equal to or higher than that of the material of the printing element board 2000, for example, any of silicon, aluminum nitride, zirconia, silicon nitride, silicon carbide, molybdenum, and tungsten may be used. Further, materials having lower thermal conductivity than that of the printing element board 2000 (e.g., a resin material) may be used.

The ink channel 4200 for supplying the ink of the same color to the ink supply ports 2210 to 2230 of the printing element board 2000 is formed in the support member 4000. In the recording head used in the recording apparatus of the present embodiment, the ink of an amount in accordance with the consumed ink volume is supplied to the ink channel 4200 from an ink reservoir unit (not illustrated). However, the configuration of the recording head included in the recording apparatus to which the present invention is applicable is not limited to the same: a recording head of a configuration in which the ink in the ink channel 4200 circulates compulsorily by a circulation unit (not illustrated) may also be employed.

The printing element board 2000 is joined and fixed to the support member 4000 at an outer peripheral portion of the back surface of the printing element board 2000 and in the regions between each of the ink supply ports, so that the ink supply ports 2210 to 2230 communicate with the ink channel 4200 of the support member 4000. An adhesive used for the joint desirably has low viscosity and low curing temperature, cures in a short time, and has ink resistance properties. For example, a UV-thermosetting combination adhesive consisting mainly of epoxy resin is used. The thickness of an adhesive layer using that adhesive is desirably equal to or smaller than 50 μm.

An electric wiring member 5000 forms, on the printing element board 2000, an electrical signal path and an electric power supply path that apply the drive signals to the heater 2100 for the ejection of the ink droplets. The electric wiring member 5000 includes an aperture corresponding to the printing element board 2000. The electric wiring member 5000 is joined to the support member 4000 near the printing element board 2000.

Electrode terminals 5100 connected to the electrode portions 2300 of the printing element board 2000 are formed near upper and lower edges of the aperture of the electric wiring member 5000. External signal input terminals (not illustrated) for receiving the drive signals from the apparatus main body are formed at an end portion of the electric wiring member 5000. The external signal input terminals (not illustrated) are connected to the electrode terminals 5100 with a continuous circuit pattern of copper foil.

Electrical connection between the electric wiring member 5000 and the printing element board 2000 is established by, for example, wire bonding between the electrode portions 2300 of the printing element board 2000 and the electrode terminals 5100 of the electric wiring member 5000. Such an electric connection portion is sealed with a sealing agent 6100 to avoid corrosion by the ink and damage by external force. A gap between the printing element board 2000 and the electric wiring member 5000 is sealed by a sealing agent 6200.

The recording apparatus according to the first embodiment of the present invention includes, not restrictive but illustrative, a recording head that uses a heater and has three ink supply port arrays arranged in parallel as illustrated to FIGS. 2 to 4. Alternatively, the present invention is applicable also to a recording apparatus of a similar configuration in which a heater is used and two, or four or more ink supply port arrays are arranged in parallel. Alternatively, the present invention is applicable also to a recording apparatus provided with a recording head, which is a linear recording head used in a page printer of a similar configuration in which at least two ink supply port arrays are arranged in parallel.

The recording apparatus according to the first embodiment of the present invention includes a control configuration including a CPU, ROM, RAM, and other storage media to drive the heater corresponding to each of the ejection ports of each ejection port array of the recording head of the configuration described above by drive signals. The recording apparatus can be operated in a plurality of operation modes regarding print image quality and/or printing speed. A user can select and set desired mode. When a user mode is set and a printing instruction is sent to the recording apparatus from a host apparatus, the control configuration is operated. When the CPU executes a program loaded to the RAM from ROM or a storage medium or from the outside through a communication unit, the operation in the first embodiment of the present invention along the flowchart illustrated in FIG. 5 is executed.

Figure 5:
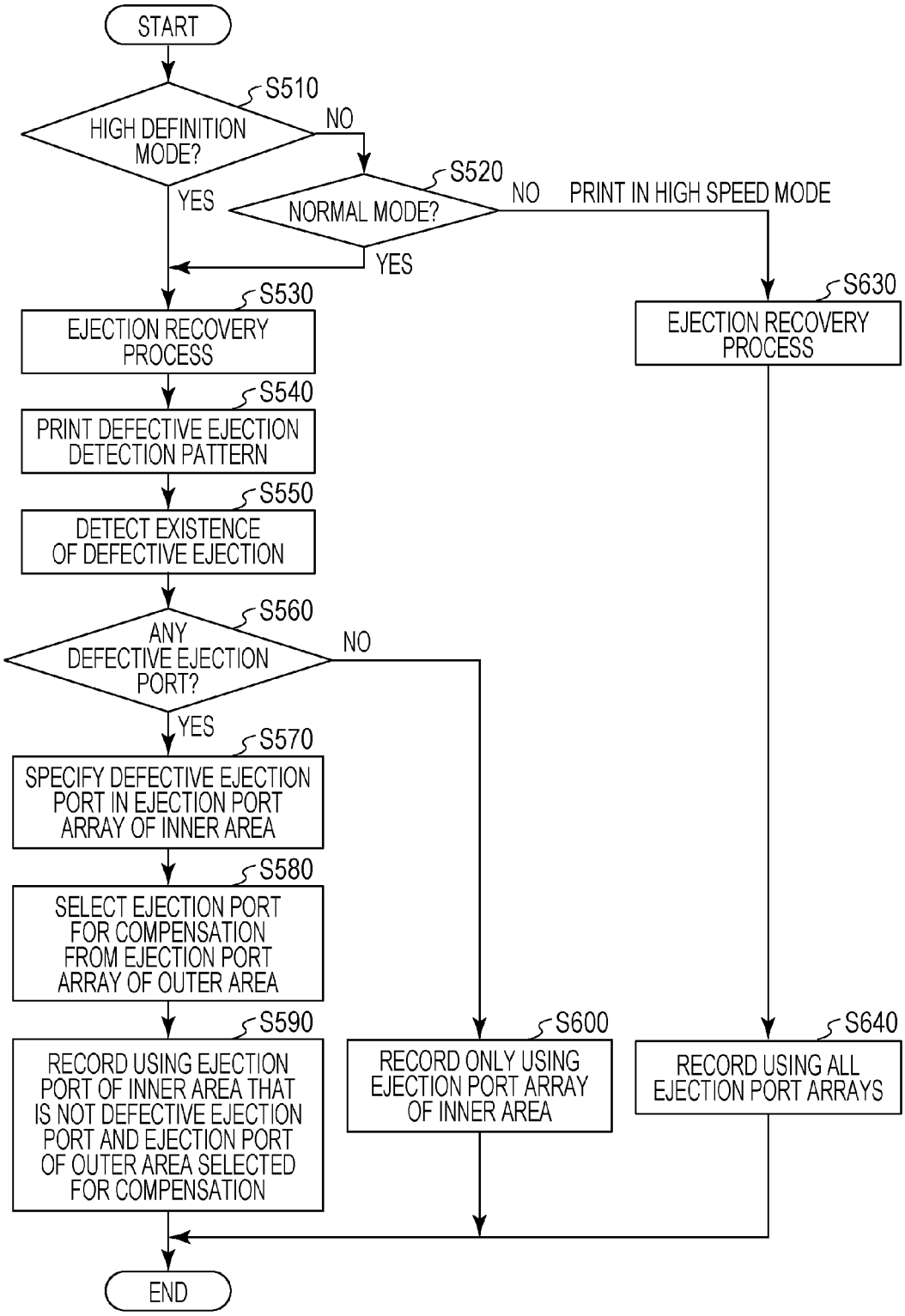
FIG. 5 is a flowchart of an operation of the recording apparatus according to the first embodiment of the present invention.

In the flowchart of FIG. 5, the operation mode set by the user is determined (S510, S520). If the mode is an image quality priority mode, recording is performed with a limited number of ejection port arrays (S530 to S600). If the mode is a speed priority mode, recording is performed using all the ejection port arrays (S630, S640). In particular, if it is determined that "high definition mode" is not selected in S510 and that "normal mode" is not selected in S520, "high speed mode" in which priority is given to the printing speed over the print image quality in recording images has been selected. In this case, the process proceeds to S630 and an ejection recovery process is performed to all the ejection ports of all the ejection port arrays 3310 to 3360 (see FIG. 6). Then, in S640, each heater is driven by the drive signals based on the image data for the image to be recorded so that ejection for high-speed image recording is performed in a shorter time using all the ejection port arrays 3310 to 3360. The ejection port arrays 3310 and 3360 in the outer areas have temperatures that are not the same as those of the ejection port arrays 3320 to 3350 in the inner area of the printing element board 2000. Since these ejection port arrays 3310 and 3360 in the outer areas are used together with the ejection port arrays 3320 to 3350 in the inner area, recording can be performed at a high speed with certain reduction in image quality. In this specification, the "outer area" refers to a region along the ends of the substrate at which two ejection port arrays of both sides in the direction in which a plurality of ejection port arrays are arranged are disposed on the printing element board, and the "inner area" refers to a region between the two "outer areas."

The ejection recovery process of S630 is performed for prevention of defective ejection, such as clogging of the ejection ports of the recording head, or reduction in image quality caused by an increase in ink concentration due to evaporation of moisture content from the ejection ports. In S630, each heater is driven by signals for the ejection recovery process that are not based on the image data for the image to be recorded and ink droplets are ejected from the recording head, whereby ink with increased viscosity and the like in the ejection ports are discharged. In the present embodiment in which the serial type recording head 1000 is used, the ejection recovery process is performed as out-of-paper auxiliary ejection (e.g., into a cap other than the recording medium). If the present invention is applied to a page printer in which a linear recording head is used, the ejection recovery process is performed toward the recording medium as on-paper auxiliary ejection. The on-paper auxiliary ejection includes a system in which the ink droplets are ejected between a plurality of images to be recorded on the recording medium (inter-image auxiliary ejection), and a system in which ink droplets are ejected in the image to be recorded (in-image auxiliary ejection).

If "high definition mode" in which priority is given to image quality over speed has been selected as a result of the mode determination in S510, and if "normal mode" in consideration of the balance of image quality and speed is has been selected as a result of mode determination in S510 and S520, the process proceeds to S530 and subsequent steps. That is, after the same ejection recovery process as that in S630 is performed in S530, whether there is a defective ejection in each ejection port of the ejection port arrays S320 to S350 (S540 to S560) is detected, and the heater is controlled to be driven in accordance with the detection result.

First, a defective ejection detection pattern is formed by a well-known technique (S540). Next, the pattern is scanned by a well-known technique with an optical device to detect existence of defective ejection (S550). Here, if there is no defective ejection in any of the ejection ports of the ejection port arrays 3320 to 3350 in the inner area of the printing element board 2000, an image is recorded using these ejection port arrays 3320 to 3350 and not using the ejection port arrays 3310 and 3360 in the outer areas (S560, S600). The image data is distributed and allocated substantially equally to each ejection port of the ejection port arrays 3320 to 3350 and, therefore, specific ejection port arrays or specific ejection ports are not used intensively. Therefore, since heat generation in the inner area of the printing element board 2000 is uniform, the substrate temperature is uniform, and the ejection port arrays 3310 and 3360 of the area of which temperature is not the same as that in the inner area are not used for the image recording, images free from unevenness of density by temperature change, and excellent in color reproducibility may be recorded.

If it is determined in S560 that defective ejection exists in some ejection ports, then, a defective ejection compensation process is performed about the ejection ports in the ejection port arrays 3320 to 3350 where defective ejection was detected, and then an image is recorded (S570 to S590). The defective ejection compensation process is a technique to prevent, for example, generation of white streaks in the recorded image about the ejection ports in which defective ejection has caused due to dust contamination and heater failure, whereby influences on the recorded image are reduced to the minimum. In the defective ejection compensation process of the present embodiment, as described in detail below, ejection of the ink droplets that should have been made by the ejection ports where defective ejection was detected in the ejection port arrays 3320 to 3350 in the inner area of the printing element board 2000 is compensated for by ejection of the ink droplets from the ejection port arrays 3310 and 3360 in the outer area.

Hereinafter, with reference to the schematic plan view of the recording head illustrated in FIG. 6, the processes of S570 and thereafter are described in detail.

Figure 6:
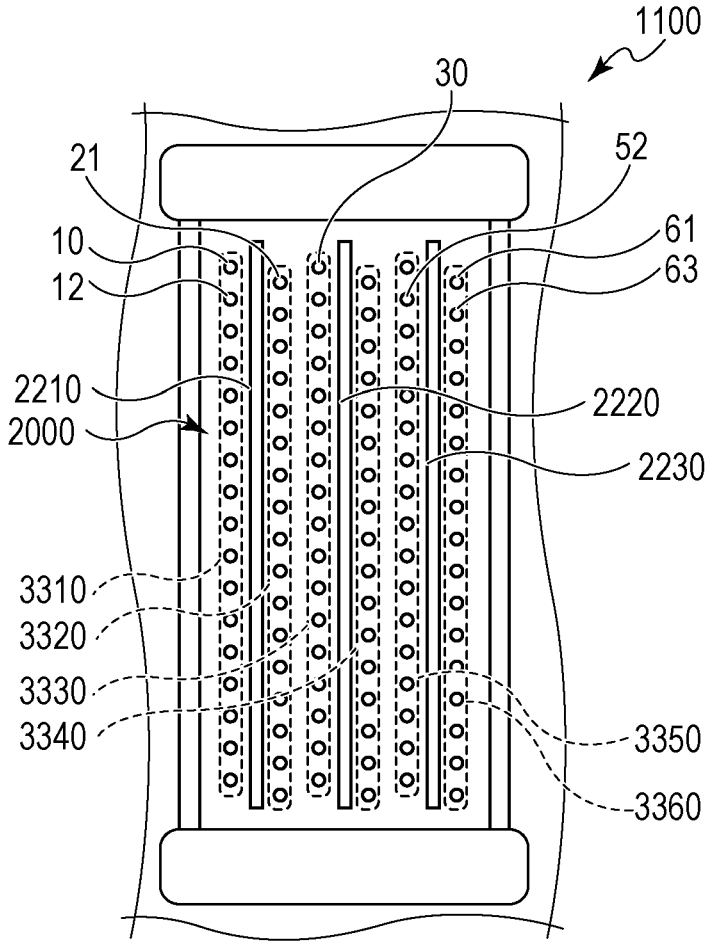
FIG. 6 is a plan view of an ejection port array in the recording head used in the recording apparatus according to the first embodiment of the present invention.

In FIG. 6, the ejection port array 3310 is arranged along the left end portion of the printing element board 2000 in the direction in which the ejection ports are arranged, which is a predetermined direction, and is the ejection port array located close to the left end portion. The ejection port array 3360 of the opposite side of the printing element board 2000 is arranged along the right end portion of the printing element board 2000, and is located closest to the right end portion and furthest from the left end portion. In a set of the ejection port array 3310 and the ejection port array 3320, the ejection ports are arranged in a staggered pattern (a zig-zag pattern). That is, in the ejection port array 3310 and the ejection port array 3320, a predetermined number of ejection ports are arranged at, for example, ½ pitches corresponding to 1200 dpi, and the ejection ports are shifted from one another by ½ pitches. Therefore, a set of the ejection port array 3310 and the ejection port array 3320 may be treated as a single ejection port array in which the ejection ports are arranged at the pitch corresponding to 2400 dpi. This is true to the ejection port arrangement of other set of the ejection port array 3330 and the ejection port array 3340, and to the ejection port arrangement of other set of the ejection port array 3350 and the ejection port array 3360. The ejection port arrays 3310, 3330, and 3350 have the ejection ports on the same lines in the head scanning direction, and the ejection port arrays 3320, 3340, and 3360 have the ejection ports on the same lines of the head scanning direction. Therefore, during the head scanning, three ejection ports of a single recording element unit 1100 may pass through the same location on the recording medium.

The flowchart of FIG. 5 is referred to again. If defective ejection exists in the ejection ports of the ejection port arrays 3320 to 3350 in the inner area, the defective ejection ports in the ejection port arrays 3320 to 3350 are specified in S570.

Subsequently, in S580, an ejection port to compensate for the specified ejection port is selected from the ejection ports of the ejection port arrays 3310 and 3360 in the outer area. In FIG. 6, if, for example, an ejection port 21 is specified as the defective ejection port, an ejection port 61 of the ejection port array 3360 in the outer area on the same line with the ejection port 21 is selected. If, for example, an ejection port 30 is specified as the defective ejection port, an ejection port 10 of the ejection port array 3310 in the outer area on the same line with the ejection port 30 is selected. Alternatively, if the ejection port 21 is specified as the defective ejection port, either the ejection port 10 or the ejection port 12 of the ejection port array 3310 in the outer area located on the line adjacent to that of the ejection port 21 may also be selected. Further, if an ejection port 52 is specified as the defective ejection port, either the ejection port 61 or an ejection port 63 of the ejection port array 3360 in the outer area located on the line adjacent to that of the ejection port 52 may also be selected similarly. In the next S590, an image is recorded using the ejection ports that are not defective ejection ports in the ejection port arrays 3320 to 3350 in the inner area, and the ejection ports in the ejection port arrays 3310 and 3360 in the outer area selected for the compensation of the defective ejection ports. The image data is distributed and allocated substantially equally to each ejection port of the ejection port arrays 3320 to 3350 and, therefore, specific ejection port arrays or specific ejection ports are not used intensively. The image data allocated to the defective ejection ports is reallocated to ejection ports of the same or adjacent line in the ejection port array 3310 or 3360 in the outer area. However, the ratio of the ejection ports for which reallocation is performed with respect to all the ejection ports in the ejection port arrays 3320 to 3350 is very low. Therefore, heat generation in the inner area of the printing element board 2000 is uniform, the substrate temperature is uniform. Since the amount of heat generation is very small and the possibility that the ejection port arrays 3310 and 3360 in the outer area having different temperature from that in the inner area are used in image recording is very small, influences on image quality may be ignored.

The ink supply ports 2210 and 2230 are formed to penetrate the printing element board 2000 and, as illustrated, for example, in FIG. 6, the ink supply port 2210 extends between the ejection port array 3310 and the ejection port array 3320, and the ink supply port 2230 extends between the ejection port array 3350 and the ejection port array 3360. Therefore, since the amount of heat from the heater corresponding to the ejection port array 3320 or 3350 transferred to the left or the right side outer area of the printing element board 2000 in FIG. 6 is very small, a decrease in temperature near the ejection port arrays 3320 and 3350 may be ignored.

Figure 7:
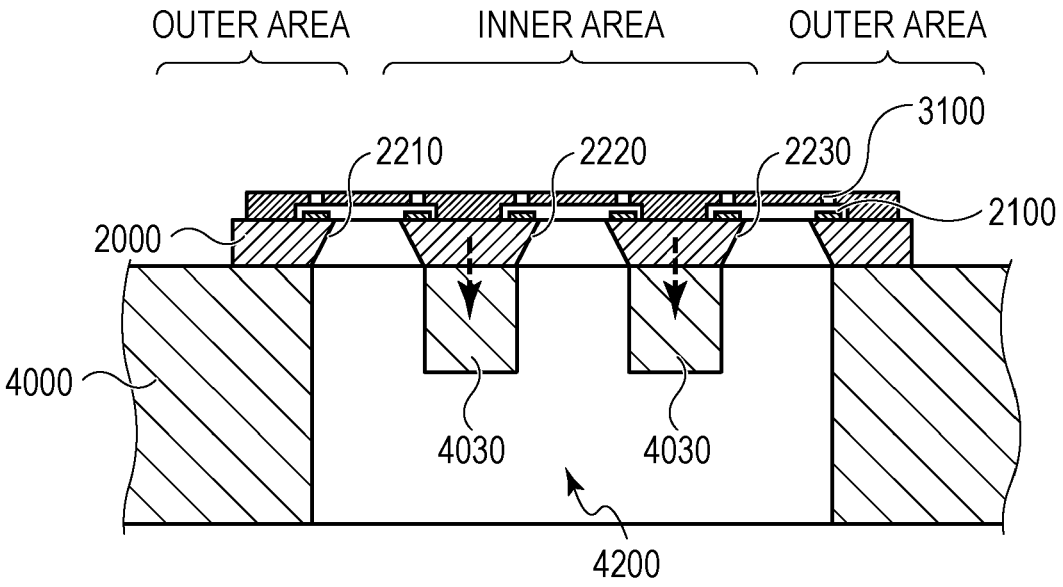
FIG. 7 illustrates a heat transfer path in the recording head used in the recording apparatus according to the first embodiment of the present invention.

From the description above, a heat transfer path when the control of S570 to S590 is performed to the recording head of the configuration described above included in the recording apparatus of the present embodiment is as schematically illustrated in FIG. 7. As illustrated in FIG. 7, the heat generated in the outer areas of both sides of the printing element board 2000 may be ignored substantially because the ejection port arrays in the outer areas are used only for the compensation of defective ejection and the like. The heat from the ejection port arrays in the inner area of the printing element board 2000 are transferred to beam portions 4030 of the support member 4000. That is, the destination to which the heat from the ejection port arrays in the inner area is transferred is the same beam portion (4030) and, therefore, the heat from the inner area is transferred uniformly. Therefore, as a result of performing the processes S570 to S590 for the defective ejection compensation, images free from unevenness of density by temperature change, and excellent in color reproducibility may be recorded.

Modification of First Embodiment

In the selection process of S580, the ejection ports for compensation are selected from the outer area when the defective ejection ports are detected in the inner area. However, other ejection ports in the inner area may be selected as ejection ports for compensation when the defective ejection ports are detected in the inner area. In this case, other ejection ports in the same or adjacent line as in the selection process of S580 may be selected, or other ejection ports adjoining in the arranging direction which is the predetermined direction may be selected. Further, if other ejection ports in the same or adjacent line or other ejection ports adjoining in the arranging direction cannot be used because of defective ejection, ejection port for compensation may be selected from the outer area.

Second Embodiment

In the present embodiment, common printing element boards are used among a plurality of recording heads, and some of a plurality of ejection port arrays on the printing element board are restricted not to be used for the image recording in order to reduce uneven temperature distribution on the printing element board that may cause unevenness of density of the recorded image. The ejection recovery process is performed to the some of the ejection ports of the ejection port array. The defective ejection compensation process performed in the first embodiment is not performed.

The recording apparatus according to the present embodiment has the recording head including the recording element unit 1100 for single color ink of the same configuration as that disclosed in the first embodiment as illustrated in FIGS. 2 to 4. Like the first embodiment, a plurality of recording element units 1100 may be provided for different colors of ink to perform color recording.

In the present embodiment, specifically, use of the ejection port arrays 3310 and 3360 in both the outside areas of the printing element board 2000 illustrated in FIG. 4 is restricted so that the ejection port arrays 3310 and 3360 are not used in image recording on the recording medium and used only for the ejection recovery process. The ejection port array 3310 performs the ejection recovery process when needed. In particular, when the ink in ink supply port 2210 is concentrated due to generated heat of the heater corresponding to the ejection port array 3320 or the like, the ejection recovery process is performed periodically to prevent the concentrated ink from being ejected from the ejection port array 3320 for image recording. The ejection port array 3360 performs the ejection recovery process in a similar manner.

As described above, the ejection port array 3310 and the ejection port array 3360 eject the ink droplets only for the ejection recovery process as needed. Other ejection port arrays perform recording in the same manner as in S600 (FIG. 5) of the first embodiment, without determining existence of defective ejection. Therefore, the image data is distributed and allocated substantially equally to each ejection port of the ejection port arrays 3320 to 3350 and, specific ejection port arrays or specific ejection ports are not used intensively. The heat from the ejection port arrays in the inner area of the printing element board 2000 is transferred to the beam portion 4030 of the support member 4000. That is, the destination to which the heat from the ejection port arrays in the inner area is transferred is the same beam portion 4030 and, therefore, the heat from the inner area is transferred uniformly. The ejection port arrays 3310 and 3360 in the outer area are not used for the image recording. Therefore, images free from unevenness of density by temperature change, and excellent in color reproducibility may be recorded.

The recording apparatus according to the second embodiment of the present invention includes, not restrictive but illustrative, a recording head that uses a heater and has three ink supply port arrays arranged in parallel as illustrated to FIGS. 2 to 4. Alternatively, the present invention is applicable also to a recording apparatus of a similar configuration in which a heater is used and two, or four or more ink supply port arrays are arranged in parallel. Alternatively, regarding a linear recording head used in a page printer, the present invention is applicable also to a recording apparatus provided with a recording head of a similar configuration in which at least two ink supply port arrays are arranged in parallel.

According to the configuration described above, problems of unevenness of density and color reproducibility of an image caused by unevenness of temperature distribution on the printing element board may be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-219049, filed Oct. 28, 2014, which is hereby incorporated by reference herein in its entirety.

What is claimed is:

1. An apparatus comprising:

a recording head provided with a plurality of ejection port arrays each including a plurality of ejection ports for ejecting a liquid and heaters each provided corresponding to each of the ejection ports, the ejection port arrays being disposed on a printing element board and arranged in a predetermined direction; and a driving unit configured to drive the heaters corresponding to the ejection ports in the plurality of ejection port arrays to eject the liquid, the driving unit giving priority to the heater corresponding to other ejection port array except for a first ejection port array and a second ejection port array of both sides in the predetermined direction among the plurality of ejection port arrays disposed in the predetermined direction to drive for recording.

2. The apparatus according to claim 1, wherein the driving unit includes:

a detection unit configured to detect defective ejection of each ejection port of other ejection port array; and a compensation unit configured to drive the heater corresponding to the ejection port using a drive signal based on image data allocated to an ejection port in which defective ejection has not been detected, and, using the drive signal based on the image data allocated to the ejection port in which defective ejection has been detected, of the first ejection port array or the second ejection port array, drive the heater corresponding to the ejection port of the same position as the ejection port or a position near the ejection port in the predetermined direction to cause the ejection port of the same position or the near position to compensate for the image recording that should have been recorded by the ejection port in which defective ejection was detected.

3. The apparatus according to claim 2, further comprising:

a unit for setting a mode of print image quality and/or printing speed, wherein the driving unit further includes a determination unit configured to determine whether the set mode gives priority to the printing speed and, if it is determined that the set mode does not give priority to the printing speed, the detection unit detects defective ejection about each ejection port of other ejection port array.

4. The apparatus according to claim 2, wherein when the drive signal is not based on the image data but is a signal for an ejection recovery process of the recording head, the driving unit drives the heater of the first and second ejection port arrays and the heater of other ejection port array in accordance with the drive signal.

5. The apparatus according to claim 1, wherein, when the drive signal is based on the image data, the driving unit drives the heater of other ejection port array without driving the heater of the first and the second ejection port arrays.

6. The apparatus according to claim 1, wherein the recording head is a liquid channel communicating with the ejection ports of the first ejection port array, and includes a liquid channel further communicating with the ejection ports of the second ejection port array and the ejection ports of other ejection port array.

7. A method for driving a recording head provided with a plurality of ejection port arrays each including a plurality of ejection ports for ejecting a liquid and heaters each provided corresponding to each of the ejection ports, the ejection port arrays being disposed on a printing element board and arranged in a predetermined direction, the method comprising:

a driving step of driving the heaters corresponding to the ejection ports in the plurality of ejection port array to eject the liquid, the driving step giving priority to the heater corresponding to other ejection port array except a first ejection port array and a second ejection port array of both sides in the predetermined direction among the plurality of ejection port arrays disposed in the predetermined direction to drive for recording.

8. The driving method according to claim 7, wherein the driving step includes:

a detecting step of detecting defective ejection of each ejection port of other ejection port array; and a compensating step of driving the heater corresponding to the ejection port using a drive signal based on image data allocated to an ejection port in which defective ejection has not been detected, and, using the drive signal based on the image data allocated to the ejection port in which defective ejection has been detected, of the first ejection port array or the second ejection port array, driving the heater corresponding to the ejection port of the same position as the ejection port or a position near the ejection port in the predetermined direction to cause the ejection port of the same position or the near position to compensate for the image recording that should have been recorded by the ejection port in which defective ejection was detected.

9. The driving method according to claim 8, further comprising:

a setting step of setting a mode of print image quality and/or printing speed are before the driving step, wherein the driving step further includes, before the detecting step, a determining step of determining whether the set mode is the mode to give priority to the printing speed, and when it is determined that the mode is not the mode to give priority to the printing speed, in the detecting step, defective ejection is detected in each ejection port of other ejection port array.

10. The driving method according to claim 7, wherein, when the drive signal is based on the image data, in the driving step, the heater of other ejection port array is driven without driving the heaters of the first and second ejection port arrays.

* * * * *